US008702162B2

(12) United States Patent
Isaacson

(10) Patent No.: US 8,702,162 B2
(45) Date of Patent: Apr. 22, 2014

(54) MULTIPLE USE CHAIR

(76) Inventor: Myron Isaacson, Lafayette, MN (US)

( * ) Notice: Subject to any disclaimer, the term of this patent is extended or adjusted under 35 U.S.C. 154(b) by 546 days.

(21) Appl. No.: 12/802,639

(22) Filed: Jun. 10, 2010

(65) Prior Publication Data

US 2011/0018314 A1 Jan. 27, 2011

Related U.S. Application Data

(60) Provisional application No. 61/268,213, filed on Jun. 10, 2009, provisional application No. 61/342,656, filed on Apr. 16, 2010.

(51) Int. Cl.
*A47C 4/20* (2006.01)

(52) U.S. Cl.
USPC ..... 297/47; 297/16.1; 297/54; 297/59; 297/195.11

(58) Field of Classification Search
USPC ..... 297/17, 32, 47, 54, 195.11, 487, 16.1
See application file for complete search history.

(56) References Cited

U.S. PATENT DOCUMENTS

| | | | | | |
|---|---|---|---|---|---|
| 1,672,437 | A * | 6/1928 | Vance | 297/32 |
| 2,694,441 | A * | 11/1954 | Degenfelder | 297/17 |
| 5,072,955 | A * | 12/1991 | Holland et al. | 280/32.5 |
| 5,375,905 | A * | 12/1994 | Flitter et al. | 297/15 |
| 5,624,153 | A * | 4/1997 | Censullo, Jr. | 297/59 |
| 6,425,590 | B1 * | 7/2002 | Whiteside et al. | 297/17 |
| 6,926,365 | B2 * | 8/2005 | Bottoms | 297/423.12 |
| 7,156,456 | B1 * | 1/2007 | Chen | 297/32 |
| 7,178,868 | B2 * | 2/2007 | Richardson et al. | 297/195.11 |
| 2007/0187996 | A1 * | 8/2007 | Shabram | 297/16.1 |

* cited by examiner

*Primary Examiner* — Peter Brown
(74) *Attorney, Agent, or Firm* — Lee Pederson

(57) ABSTRACT

A portable chair provides multiple comfortable sitting positions for various outdoor uses. In one position, a spear fisher may comfortably and safely lean over a hole while having support for the back, neck and arms.

2 Claims, 7 Drawing Sheets

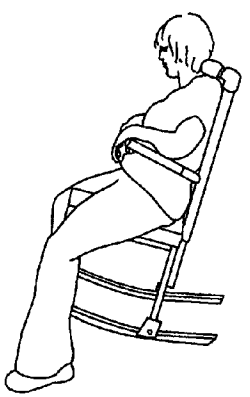
FIG. 11
FIG. 12
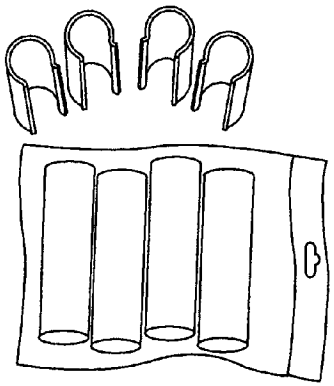
FIG. 13
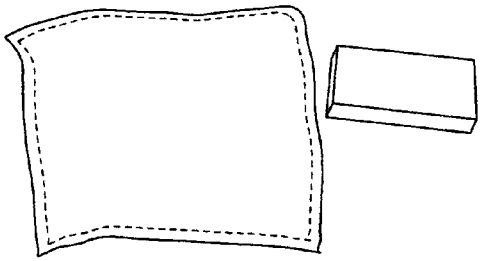
FIG. 14
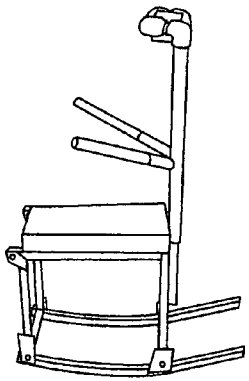
FIG. 15

MULTIPLE USE CHAIR

PRIORITY CLAIM

This application claims priority to U.S. provisional patent application No. 61/268,213 entitled "Multiple Use Chair" and filed on Jun. 10, 2009, and also to U.S. provisional patent application No. 61/342,656 entitled "Multiple Use Chair" and filed on Apr. 16, 2010.

FIELD OF THE INVENTION

The present invention relates to chairs. More particularly, the present invention relates to chairs with multiple uses, but especially those useful for ice fishing and outdoor enjoyment.

BACKGROUND OF THE INVENTION

When ice fishing with a spear in a dark house, a fisherman typically leans forward over the hole with no support. This may be both uncomfortable and dangerous.

BRIEF DESCRIPTION OF THE INVENTION

A portable chair provides multiple comfortable sitting positions for various outdoor uses. In one position, a spear fisher may comfortably and safely lean over a hole while having support for the back, neck and arms.

BRIEF DESCRIPTION OF THE DRAWINGS

The accompanying drawings, which are incorporated into and constitute a part of this specification, illustrate one or more embodiments of the present invention and, together with the detailed description, serve to explain the principles and implementations of the invention.

In the drawings:

FIG. 11 depicts a user demonstrating the first embodiment in a second angling position.

FIG. 12 depicts a user demonstrating the first embodiment in a relaxed sitting position.

FIG. 13 depicts commercial packaging and snap clamps useful for attaching a biodegradable bag to the frame.

FIG. 14 depicts commercial packaging and biodegradable bags which may be clamped to the frame.

FIG. 15 depicts the first embodiment in a fully assembled and upright position.

DETAILED DESCRIPTION

Embodiments of the present invention are described herein in the context of a multiple use chair. Those of ordinary skill in the art will realize that the following detailed description of the present invention is illustrative only and is not intended to be in any way limiting. Other embodiments of the present invention will readily suggest themselves to such skilled persons having the benefit of this disclosure. Reference will now be made in detail to implementations of the present invention as illustrated in the accompanying drawings. The same reference indicators will be used throughout the drawings and the following detailed description to refer to the same or like parts.

In the interest of clarity, not all of the routine features of the implementations described herein are shown and described. It will, of course, be appreciated that in the development of any such actual implementation, numerous implementation-specific decisions must be made in order to achieve the developer's specific goals, such as compliance with application- and business-related constraints, and that these specific goals will vary from one implementation to another and from one developer to another. Moreover, it will be appreciated that such a development effort might be complex and time-consuming, but would nevertheless be a routine undertaking of engineering for those of ordinary skill in the art having the benefit of this disclosure.

The present invention is a portable multiple use chair, which is especially useful for ice fishing. The chair may be folded for easy transport and storage. The chair is sturdy, and preferably has a light weight metal frame. Two embodiments of the invention are disclosed herein in detail.

Figure 1:
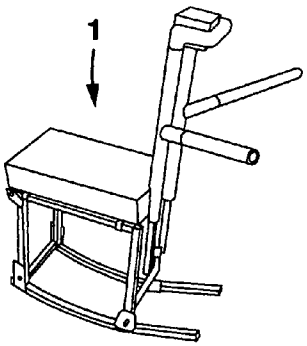
FIG. 1 depicts a first embodiment of the invention in the upright and fully assembled position.

FIG. 1 depicts the first embodiment 1 of the invention in the upright and fully assembled position.

Figure 23:
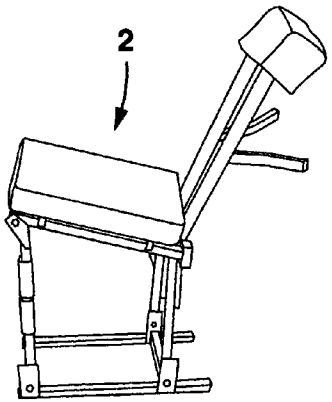
FIG. 23 depicts a second embodiment of the invention in the upright and fully assembled position.

FIG. 23 depicts the second embodiment 2 of the invention in the upright and fully assembled position.

Figure 10:
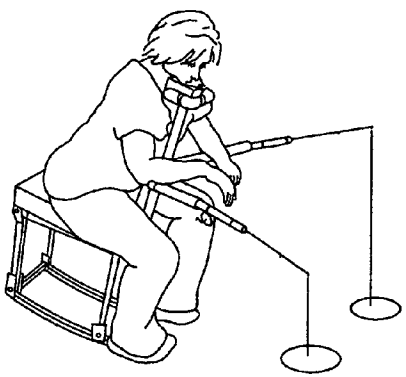
FIG. 10 depicts a user sitting on the first embodiment in an angling position.

The first and second embodiments have many common features. Both can be sat on in both a forward and backward position (see, e.g., FIG. 10 and FIG. 12) and both have the same basic components.

Figure 2:
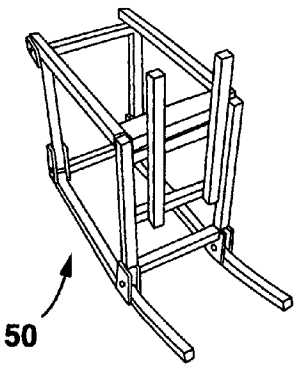
FIG. 2 depicts the frame of the first embodiment in an upright position.
Figure 3:
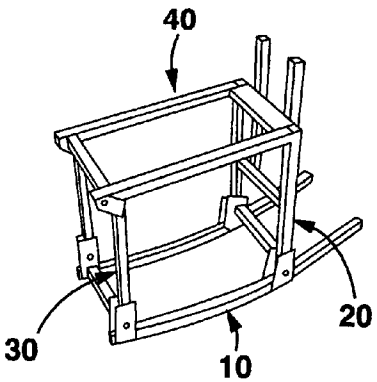
FIG. 3 depicts the frame of the first embodiment in an upright position.
Figure 4:
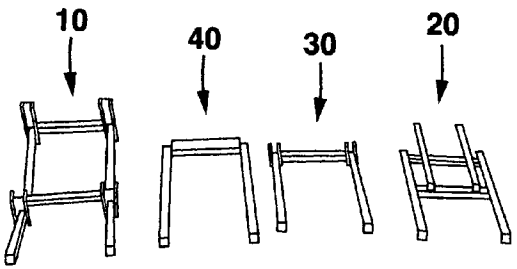
FIG. 4 depicts the structural elements of the frame of the first embodiment before the elements are connected.
Figure 19:
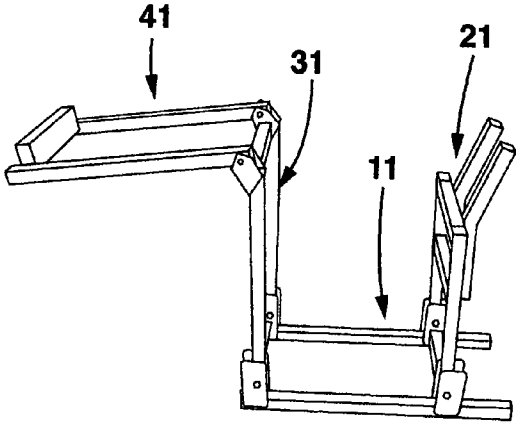
FIG. 19 demonstrates the "front" legs upright and held vertically by a stop on the base assembly.

FIG. 4 depicts the structural elements of the frame of the first embodiment before the elements are connected. The same components, with the differences described herein, also comprise the second embodiment. Referring now to FIGS. 3 and 19, base assembly 10 or 11, proximal end leg assembly 20 or 21, distal end leg assembly 30 or 31, and seat support assembly 40 or 41, together comprise the frame 50 (see, e.g., FIG. 2). The frame is held together by fasteners, e.g., nuts and bolts or hinges. Chest or body support members (60, 62 and 64 in FIG. 5) are further included in both embodiments.

There are two differences between the embodiments. The base assembly of the first embodiment has three planar ground contact surfaces while the base assembly of the second embodiment has a single planar ground contact surface. Also, the distal end leg assembly is substantially the same height as the proximal end leg assembly when both assemblies are in perpendicular position in the first embodiment, while in the second embodiment the distal end leg assembly is taller than the proximal end leg assembly when both assemblies are in perpendicular position.

Figure 8:
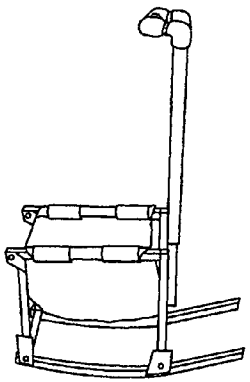
FIG. 8 is a picture showing a biodegradable bag clamped to the frame.
Figure 7:
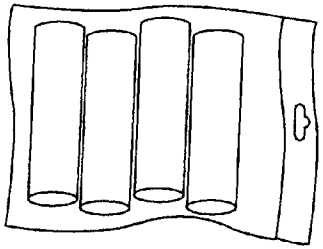
FIG. 7 depicts commercial packaging for snap clamps useful for attaching a biodegradable bag to the frame.
Figure 6:
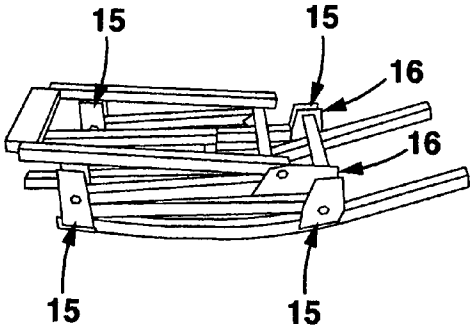
FIG. 6 depicts the frame of the first embodiment in a folded position.
Figure 9:
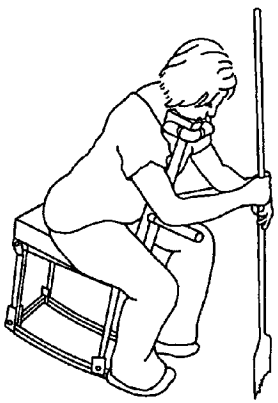
FIG. 9 depicts a user sitting on the first embodiment in a spear fishing position.

Many of the basic features of the chair are readily apparent from the attached figures. Some features and potential variations include:

a) The chair may be constructed in various sizes to accommodate users of various body types. Alternatively, telescoping structural members may be incorporated to allow adjustment for users according to their height and weight.

b) The "rockers" of the first embodiment have three flat portions to provide stability in three discrete positions as demonstrated in FIGS. 8, 9 and 11, respectively.

c) The hinge brackets 15 of the base assembly (shown, e.g., in FIG. 6) have stops 16 which prevent the legs from folding out too far. When the legs are folded in an upright position and the seat frame is folded across the legs (FIGS. 2 and 3), the entire frame locks safely into place and is stable until the seat frame is lifted. There is no need for a locking pin, though such could be employed.

d) The structural members of the frame can be square in cross-section, as shown in the prototype of the preferred embodiment. Aluminum is a preferred material for its light weight and ease of welding. Tubular steel may also be employed, which offers the advantage that swaged tubes may be used to connect elements such as the back rest/chest rest to the frame assembly. Angle irons, flat pieces, other shapes, plastics and other materials, and combinations of all the above may be used within the scope of the invention e) Jigs may be constructed to expedite manufacturing of the various elements.

f) All elements and accessories conveniently fit into a duffel bag, which may be sold with the chair.

g) The chest rest/back rest may be straight (FIG. 10) or incorporate a chin rest (FIG. 9). The chin rest is reversible, and may include a cushion.

h) The removable seat (70 in FIG. 5) preferably attaches to the frame by metal clamps.

i) The seat may be used a toilet (FIG. 8). A separate toilet seat (not shown) may be included, but is not necessary. Biodegradable bags are the preferred method of waste collection.

j) Arm rests extending from the back rest/chest support are adjustable (See FIGS. 9 and 12).

k) The second embodiment is stable when used as shown in FIG. 9. However, if additional stability is desired, the extended portion of the "rockers" may be attached to further stabilizing elements, such as a frame around the hole in the ice.

l) The chair is so stable that a person can safely sleep while sitting on it, especially in the position shown in FIG. 9.

The second embodiment has been developed to provide stable seating in limited spaces, especially portable ice fishing houses. Instead of having rockers like the first embodiment, the second embodiment has a single planar ground contact surface. The distal end of the chair is essentially vertical, so that it can fit close to a wall. The proximal end legs are positioned in relationship to the base members so the user's center of gravity is safely behind the front of the base members. Preferably the second embodiment is between about 20-22 inches long from front to back (length of base members). The seat is preferably about 16-18 inches in length, and the front of the seat is between about 20-22 inches high and the back of the seat is about 24-26 inches high when the chair is assembled. The frame and seat are preferably between about 9-12 inches wide, and more preferably about 10 inches wide. The frame preferably weighs less than about 12 pounds and the chest support and cushioned seat together preferably weigh less than about 10 pounds. As with the first embodiment, the seat and chin rest are preferably cushioned.

While the seat support assembly has been described as movably connected to the distal end leg assembly, it will be appreciated that the seat support assembly could instead be movably connected to the proximal end leg assembly. Such a configuration is within the scope of the invention.

Figure 5:
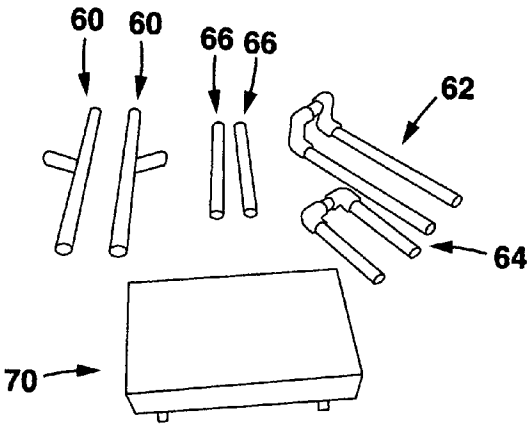
FIG. 5 depicts additional elements of the invention.
Figure 17:
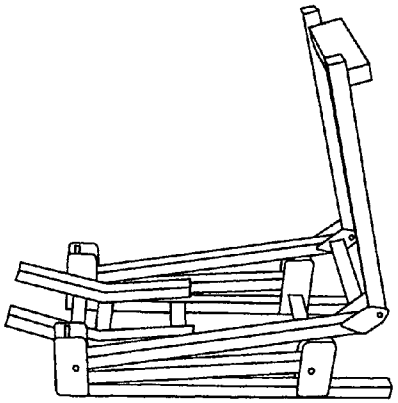
FIG. 17 demonstrates the first step in unfolding the "back" legs of the frame.
Figure 16:
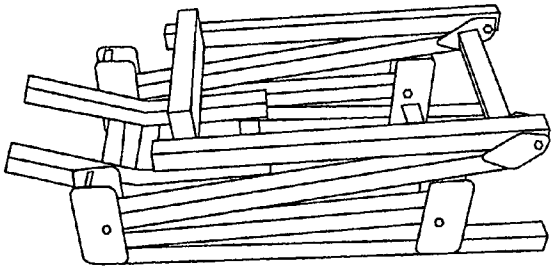
FIG. 16 depicts the frame of the second embodiment in a folded position.
Figure 18:
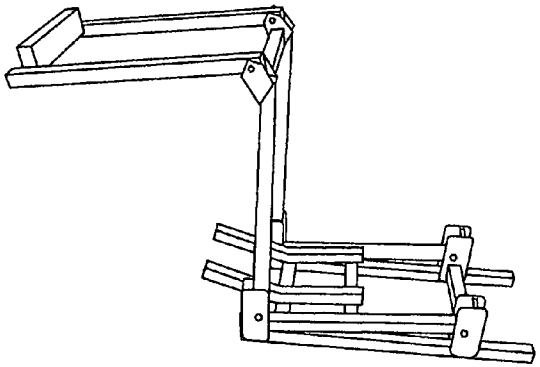
FIG. 18 demonstrates the "back" legs upright and held vertically by a stop on the base assembly.
Figure 21:
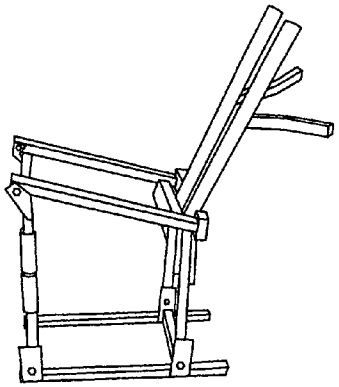
FIG. 21 demonstrates the "chest" support members attached to the frame.
Figure 20:
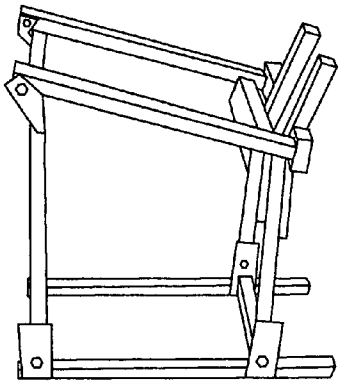
FIG. 20 demonstrates the seat support assembly locked in place between the front and the back legs.
Figure 22:
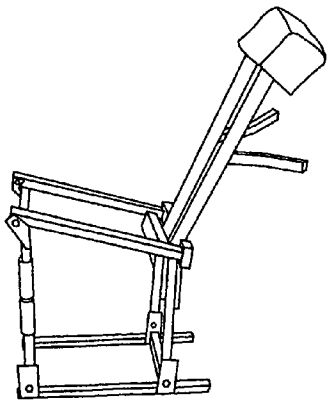
FIG. 22 demonstrates the chin rest attached to the "chest" support members.
Figure 25:
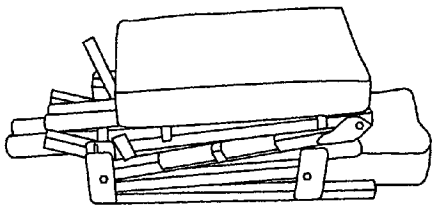
FIG. 25 demonstrates the chair in the folded position with all components stored compactly.
Figure 27:
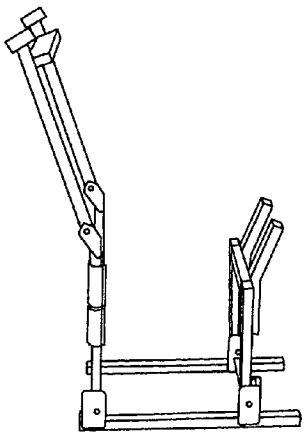
FIG. 27 depicts extra stabilizing tips on the seat support assembly.
Figure 24:
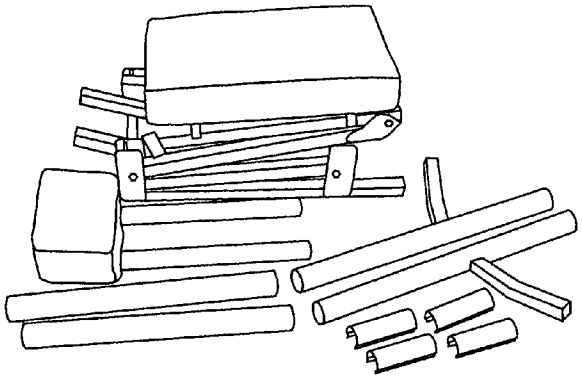
FIG. 24 demonstrates the chair in the folded position.
Figure 26:
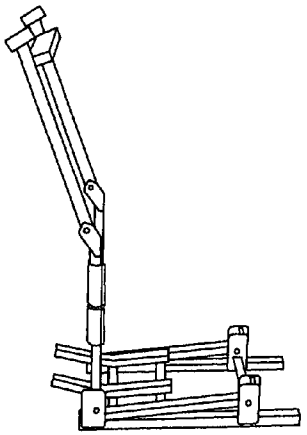
FIG. 26 depicts extra stabilizing tips on the seat support assembly.
Figure 29:
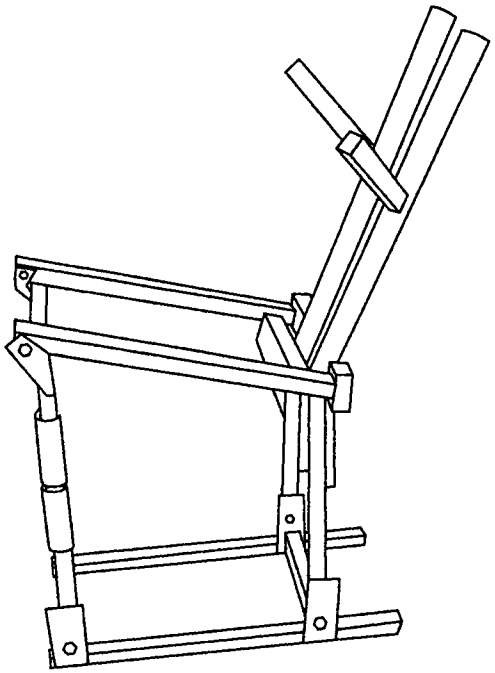
FIG. 29 depicts the frame in the upright position.
Figure 28:
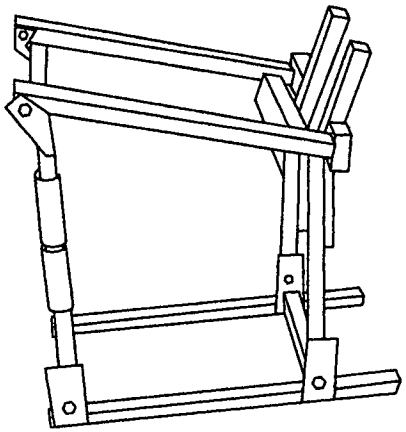
FIG. 28 depicts extra stabilizing tips on the seat support assembly.

To fully assemble the chair from the folded position to the upright position the following parts are needed: frame (e.g., 50 in FIG. 2); seat (70 in FIG. 5); body or chest supports (60 in FIG. 5); arm rests (66 in FIG. 5); and a chin or head rest (62 or 64 in FIG. 5). The frame is place on a flat surface (FIG. 16). The distal leg assembly is raised (FIGS. 17 and 18). The proximal leg assembly is raised (FIG. 19). The seat assembly is folded into place (FIG. 20). The body supports are installed (FIG. 21). Finally the arm rests, head or chin rest and seat are installed (FIG. 1 and FIG. 23).

To use the chair as a commode (FIG. 8), the seat is roved and a bio bag (e.g., FIG. 14) is attached with clips (e.g., FIG. 13).

In one aspect, the invention is a folding chair capable of either being in a folded position or in an upright position, the chair comprising:

a base assembly having a proximal end and a distal end, and having a substantially planar ground contact surface; a proximal end leg assembly, said proximal end leg assembly having two vertical members joined by a first horizontal connector, said vertical members each having a top end and a bottom end, said bottom ends of the vertical members movably connected to the proximal end of the base assembly so that the vertical members may be positioned either folded substantially in parallel with and above the planar ground contact surface or extended substantially perpendicular to the planar ground contact surface, said proximal end leg assembly further comprising one or more chest support mounting brackets; a distal end leg assembly, said distal end leg assembly having two vertical members joined by a second horizontal connector, said vertical members each having a top end and a bottom end, said bottom ends of the vertical members movably connected to the distal end of the base section so that the vertical members may be positioned either folded substantially in parallel with and above the planar ground contact surface or extended substantially perpendicular to the planar ground contact surface, and where the distal end leg assembly is taller than the proximal end leg assembly when both assemblies are in perpendicular position; a seat support assembly, said seat support assembly movably connected to the top end of the distal end leg assembly and an extending to rest on the top end of the proximal leg assembly when the chair is in the upright position; and a chest support removably connected to the chest support mounting bracket(s).

In another aspect, the invention is a folding chair capable of either being in a folded position or in an upright position, the chair comprising: a base assembly having a proximal end and a distal end, and having three substantially planar ground contact surfaces including a central contact surface, a proximal contact surface and a distal contact surface; a proximal end leg assembly, said proximal end leg assembly having two vertical members joined by a first horizontal connector, said vertical members each having a top end and a bottom end, said bottom ends of the vertical members movably connected to the base assembly at the point where the central contact surface meets the proximal contact surface so that the vertical members may be positioned either folded substantially in parallel with and above the central contact surface or extended substantially perpendicular to the central contact surface, said proximal end leg assembly further comprising one or more chest support mounting brackets; a distal end leg assembly, said distal end leg assembly having two vertical members joined by a second horizontal connector, said vertical members each having a top end and a bottom end, said bottom ends of the vertical members movably connected to the base assembly at a point where the central contact surface meets the distal contact surface so that the vertical members may be positioned either folded substantially in parallel with and above the planar ground contact surface or extended substantially perpendicular to the planar ground contact surface, and where the distal end leg assembly is substantially the same height as the proximal end leg assembly when both assemblies are in perpendicular position; a seat support assembly, said seat support assembly movably connected to the top end of the distal end leg assembly and extending to rest on the top end of the proximal leg assembly when the chair is in the upright position; and a chest support removably connected to the chest support mounting bracket(s).

While embodiments and applications of this invention have been shown and described, it would be apparent to those skilled in the art having the benefit of this disclosure that many more modifications than mentioned above are possible without departing from the inventive concepts herein. The invention, therefore, is not to be restricted except in the spirit of the appended claims.

What is claimed is:

1. A folding chair capable of either being in a folded position or in an upright position, the chair comprising:

a base assembly having a front end and a rear end, and having a substantially planar ground contact surface;

a front end leg assembly having connection points with the base assembly and a seat support area, said front end leg assembly having two vertical members joined by a first horizontal connector, said vertical members each having a top end and a bottom end, said bottom ends of the vertical members movably connected to the base assembly so that the front end of the base assembly extends forwardly from the connection points and also so that the vertical members may be positioned either folded substantially in parallel with and above the planar ground contact surface or extended substantially perpendicular to the planar ground contact surface, said front end leg assembly further comprising one or more chest support mounting brackets;

a rear end leg assembly, said rear end leg assembly having two vertical members joined by a second horizontal connector, said vertical members each having a top end and a bottom end, said bottom ends of the vertical members movably connected to the rear end of the base section so that the vertical members may be positioned either folded substantially in parallel with and above the planar ground contact surface or extended substantially perpendicular to the planar ground contact surface, and where the rear end leg assembly is taller than the seat support area of the front end leg assembly when both assemblies are in perpendicular position;

a seat support assembly, said seat support assembly movably connected to the top end of the rear end leg assembly and extending to rest on the seat support area of the front leg assembly when the chair is in the upright position; and a chest support removably connected to the chest support mounting bracket(s).

2. A folding chair capable of either being in a folded position or in an upright position, the chair comprising:

a base assembly having a proximal end and a distal end, and having three substantially planar ground contact surfaces including a central contact surface, a proximal contact surface and a distal contact surface;

a proximal end leg assembly, said proximal end leg assembly having two vertical members joined by a first horizontal connector, said vertical members each having a top end and a bottom end, said bottom ends of the vertical members movably connected to the base assembly at the point where the central contact surface meets the proximal contact surface so that the vertical members may be positioned either folded substantially in parallel with and above the central contact surface or extended substantially perpendicular to the central contact surface, said proximal end leg assembly further comprising one or more chest support mounting brackets;

a distal end leg assembly, said distal end leg assembly having two vertical members joined by a second horizontal connector, said vertical members each having a top end and a bottom end, said bottom ends of the vertical members movably connected to the base assembly at a point where the central contact surface meets the distal contact surface so that the vertical members may be positioned either folded substantially in parallel with and above the planar ground contact surface or extended substantially perpendicular to the planar ground contact surface, and where the distal end leg assembly is substantially the same height as the proximal end leg assembly when both assemblies are in perpendicular position;

a seat support assembly, said seat support assembly movably connected to the top end of the distal end leg assembly and extending to rest on the top end of the proximal leg assembly when the chair is in the upright position; and a chest support removably connected to the chest support mounting bracket(s).

* * * * *